United States Patent [19]

Norris

[11] Patent Number: 4,525,762

[45] Date of Patent: Jun. 25, 1985

[54] ARC SUPPRESSION DEVICE AND METHOD

[76] Inventor: Claude R. Norris, 9039 Normandy La., Dayton, Ohio 45459

[21] Appl. No.: 539,920

[22] Filed: Oct. 7, 1983

[51] Int. Cl.[3] ..... H01H 9/30

[52] U.S. Cl. ..... 361/13; 307/134; 361/8

[58] Field of Search ..... 361/2, 3, 8, 13; 307/134, 137, 140, 141, 141.8

[56] References Cited

U.S. PATENT DOCUMENTS

| | | | |
|---|---|---|---|
| 3,260,894 | 7/1966 | Denault . | |
| 3,555,353 | 1/1971 | Casson . | |
| 3,558,910 | 1/1971 | Dale et al. . | |
| 3,639,808 | 2/1972 | Ritzow . | |
| 3,982,137 | 9/1976 | Penrod . | |
| 4,025,820 | 5/1977 | Penrod . | |
| 4,152,634 | 5/1979 | Penrod . | |
| 4,251,845 | 2/1981 | Hancock . | |
| 4,389,691 | 6/1983 | Hancock | 361/13 X |

*Primary Examiner*—Harry E. Moose, Jr.
*Attorney, Agent, or Firm*—Wood, Herron & Evans

[57] ABSTRACT

An apparatus for the suppression of arcs at the contacts of a three phase ac electrical power contactor which has three pairs of electrical contacts and a solenoid-actuated plunger operable to open and close the contacts. One contact of each contact pair typically is connected to a source of three phase ac electrical power, and the other contact of each pair is connected to an electrical load. When the contacts are closed, the source is coupled to the load. A gate controlled thyristor is connected across each pair of the three pairs of contacts and each thyristor is gated into conduction prior to the opening or the closing of the contacts in order to suppress arcing at the contacts. The thyristors are gated on in response to the momentary closure of a mechanical switch, which is actuated as the contactor plunger moves from one of its two positions (power contacts open or power contacts closed) to the other. The mechanical switch, a sliding contact switch, is mechanically interconnected with the plunger through a linkage which increases the travel of the movable switch contact in relation to the movement of the plunger. The mechanical switch is closed in response to the initial movement of the plunger and is opened by the time the plunger completes its stroke. A gating circuit is activated to gate the thyristors as soon as the mechanical switch is closed. Thereafter, the gating circuit holds the thyristors on for a predetermined period and then turns them off. This period of time during which the triacs are gated on is determined solely by the gating circuit and is completely independent of the opening of the mechanical switch.

15 Claims, 4 Drawing Figures

ARC SUPPRESSION DEVICE AND METHOD

BACKGROUND OF THE INVENTION

This invention relates generally to the suppression of arcs across electrical power contacts, by the activation of a controlled electronic device which is coupled across the contacts, each time the power contacts are either opened or closed. The invention is disclosed particularly in relation to an electrical power contactor having a movable plunger and at least one pair of power contacts. In the disclosed form of the invention, a gate controlled thyristor is coupled across each pair of power contacts. A switch is connected to the contactor plunger and is used to activate a thyristor gating circuit for an interval of time.

In the use of electrical power switching devices, the opening and closing of the switch contacts can result in arcing across the contacts. Such arcing is objectionable because, for example, it produces radio frequency interference in other electrical equipment in the vicinity of the switching device. Equally important, such arcing degrades the switch contacts and reduces their useful life.

One technique which has been employed to prevent arcing across power contacts is to couple a thyristor, such as a triac, across the contacts. The triac is then gated into conduction prior to each opening or closing of the power contacts. Such power contacts to be protected from arcing are typically embodied in a power switching device, which may be, for example, a power relay, a motor starter, or a contactor. In such devices, typically a movable contact is moved into engagement with a pair of spaced power contacts by an actuator or plunger movable under the influence of a solenoid coil.

Therefore, to close the pair of power contacts, for example, a control voltage is applied to the solenoid coil, moving the plunger and the movable contact toward, and into engagement with, the pair of fixed contacts. Due to the inertia of the plunger, there is a delay between the application of the control voltage and the movement of the plunger. There is a further delay in the closure of the power contacts due to the distance of travel of the plunger before the movable contact reaches the fixed contacts.

In the past, gate controlled thyristors coupled across the power contacts have been gated into conduction prior to opening or closing of the power contacts in various ways. Some of these gating techniques take advantage of the above-mentioned inherent delay characteristics of the power switching devices. For example, a portion of the control current supplied to the solenoid of the switching device may be used to gate an arc suppression thyristor. Or the movement of the switching device plunger may be used to close an auxiliary switch contact, supplying a gating signal to the thyristor. In either of these systems, the thyristors would normally remain conductive while the power contacts are closed.

It has also been found, however, that it is preferable to remove the gating signal from the thyristor, even after the closing of the power contacts. The primary reason for this is that the power contacts may develop a significant resistance therebetween, requiring the thyristor to carry a substantial continuous current, which can overload the thyristor.

Preferred thyristor gating techniques, therefore, provide for gating on the thyristor before the power contacts either open or close, maintaining the thyristor conductive until after the contacts have opened or closed, and thereafter removing the gating signal from the thyristor, turning off the thyristor. This has been accomplished in a number of ways.

In one approach, an auxiliary contact is mechanically coupled to the switching device plunger. In this approach, the auxiliary contact momentarily closes an auxiliary switch as the plunger moves through its distance of travel to open or close the power contacts. While this auxiliary switch is momentarily closed, the thyristor gate is coupled to a power source, and the thyristor is gated on. When the auxiliary switch opens, the gating signal is removed and the thyristor is turned off. This thyristor gating technique requires a custom designed switching device susceptible of accurate calibration since the timing of the actuation of the thyristor depends upon the timing of both the opening and the closing of the auxiliary switch.

In another approach, a secondary coil is linked to the solenoid control coil and connected to the gate of the triac. This requires the use of a dc supply to energize the solenoid coil so that the thyristor gate receives a control signal only when the power contacts are opened or closed. Such a circuit requires that a dc supply is available to energize the solenoid, as well as the use of a switching device having a solenoid suitably actuable by a dc supply.

In other approaches to gating an arc suppression thyristor, the solenoid coil of the switching device and a gating circuit for the thyristor are both controlled by an additional arc suppression control circuit. In this case, the control voltage for the solenoid of the power switching device is not coupled directly to the solenoid, but is instead received by the arc suppression control circuit. The arc suppression control circuit contains a timing circuit to provide a thyristor gating signal for the desired interval of time to obtain satisfactory arc suppression. This timing circuit may take the form, for example, of a digital timer or a capacitor discharge timing network. Such additional control circuit arrangements permit relatively accurate electronic timing of thyristor gating, but at the cost of the introduction of fairly elaborate circuitry interposed between the externally applied solenoid control signal and the power switching device itself.

All of the foregoing arc suppression arrangements for power switching devices, therefore, require either custom design and accurate calibration of a mechanical switching device or the interposition of expensive additional control circuitry between the externally applied control signal and the power switching device. As a result, each of the prior art arc suppresion arrangements was subject to one or more serious disadvantages. The mechanical switching arrangements were delicate and difficult to calibrate; the all electrical arrangements were relatively expensive. Moreover, many of these prior art arrangements were of larger size, requiring excessive space in the control cabinet.

SUMMARY OF THE PRESENT INVENTION

It is the principal object of the present invention to provide an arc suppression device which can be mounted upon a standard contactor mechanism and which is inexpensive, compact and which requires only simple calibration.

As will be noted below with regard to an exemplary embodiment, the invention may find advantageous, but not exclusive, use in conjunction with a three phase ac power contactor. Such a contactor includes three pairs of power contacts and an armature, or plunger, movable between a first position in which the pairs of contacts are closed and a second position in which they are open. The movement of the actuator to open and close the pairs of contacts is controlled by a solenoid coil which is in turn activated by an externally applied ac voltage.

In the exemplary embodiment of the invention, the arc suppression apparatus includes three triacs, a different one of which is coupled across each of the three pairs of power contacts. The triacs are gated on in response to the momentary closure of a mechanical switch, which is actuated as the contactor plunger moves from one of its two positions (power contacts open or power contacts closed) to the other.

In accordance with the present invention, the mechanical switch, e.g., a sliding contact switch, is mechanically interconnected to the plunger through a linkage which increases the travel of the movable switch contact in relation to the movement of the plunger. The mechanical switch is closed in response to initial movement of the plunger and is opened by the time the plunger completes its stroke.

In addition to the mechanical switch, the present arc suppression device includes a gating circuit which turns the triacs off and on. This gating circuit is activated to gate the triacs on as soon as the mechanical switch is closed. Thereafter, the gating circuit holds the triacs on for a predetermined period and then turns them off. This period during which the triacs are gated on is determined solely by the gating circuit and is completely independent of the opening of the mechanical switch. Hence, it is unnecessary to calibrate the switch opening time.

In the illustrated form of the invention, the mechanical switch couples a dc potential from a dc supply, which is derived from the three phase power source, to a gating circuit including a capacitor. While the switch is closed, the dc supply provides a gating signal to the triacs so that the triacs are gated on. After the switch opens, the capacitor in the gating circuit discharges, since it is no longer coupled to the dc supply, providing a gating signal to the triacs. After the capacitor is discharged, the triacs are no longer gated and turn off.

As shall appear subsequently, the present arc suppression device can be utilized with a standard contactor device. It is substantially "transparent" to the user, i.e., the user connects the contactor in the usual manner, making no special connections for the arc suppression device. The arc suppression circuitry may be mounted above the contactor. The mechanical switch is very small and can be mounted on the side of the contactor body so that there is no appreciable increase in the contactor width and depth dimensions, or "footprint". The source and load connections for the three power phases are coupled to the arc suppression circuitry without affecting the normal connections to the contactor. The ac control voltage connections for the contactor solenoid are provided in the conventional fashion. The thyristor gating switch is mechanically coupled to an accessible portion of the contactor plunger, and two electrical leads are coupled from the switch to the arc suppression circuitry. The provision of the switch places no significant additional load upon the plunger solenoid so that a standard contactor can be used.

In addition, since the interval of time that the thyristors are activated is determined electronically, the interval during which the switch is closed is not critical. The switch should initially close shortly after the plunger begins to move and should be open by the time the plunger reaches either of its two rest positions, but the closure time of the switch is unimportant.

BRIEF DESCRIPTION OF THE DRAWINGS

These and other objects and advantages of the invention, and the manner of their implementation, will become apparent upon reading the following detailed description and upon reference to the drawings, in which.

DESCRIPTION OF THE PREFERRED EMBODIMENT

Figure 1:
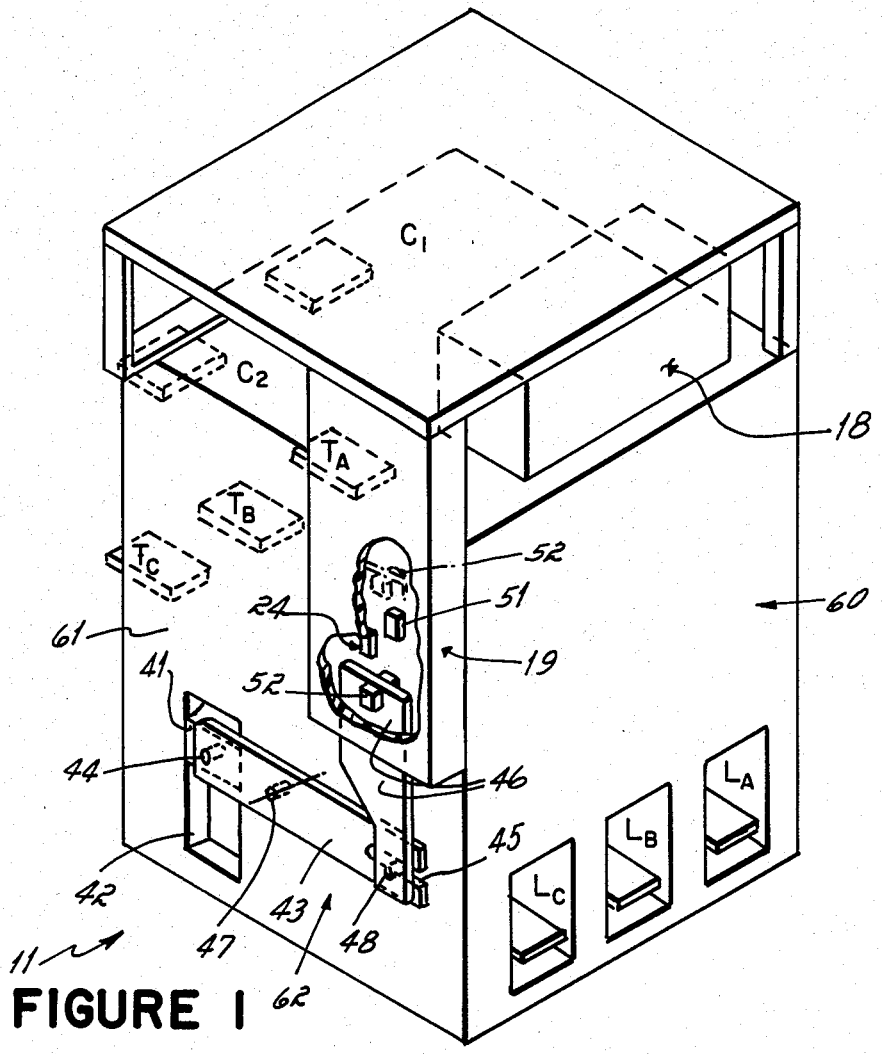
FIG. 1 is a perspective view, partially in diagrammatic form, of a contactor and an arc suppression apparatus in accordance with the present invention.

While the invention is susceptible to various modifications and alternative forms, certain illustrative embodiments have been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Figure 3:
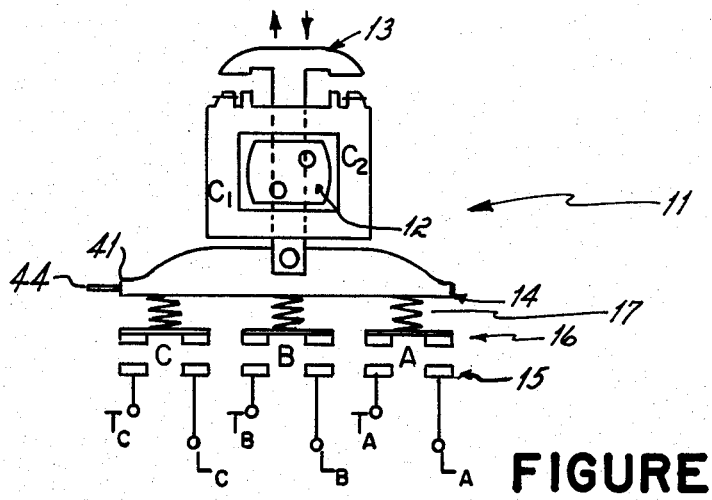
FIG. 3 is a diagrammatic illustration of the components of a typical contactor.

Turning first to FIGS. 1 and 3, an exemplary contactor 11 includes three terminals $T_A$, $T_B$, and $T_C$ couplable to a three phase power source and three terminals $L_A$, $L_B$, and $L_C$ couplable to an electrical load. A pair of control terminals $C_1$ and $C_2$ are couplable to an externally applied switchable two phase ac power source.

The terminals $T_A$–$T_C$ and $L_A$–$L_C$ are connected in the contactor to pairs of stationary contacts 15. The control terminals $C_1$ and $C_2$ are connected in the contactor to a solenoid coil 12 through which passes a movable armature or plunger 13. The plunger 13 carries an insulated contact mounting 14 to which are coupled three movable contacts 16 by means of pressure springs 17.

When an ac control voltage is applied to the terminals $C_1$–$C_2$, the plunger 13 and contact mounting 14 are moved downwardly until the movable contacts 16 are moved into engagement with the stationary contacts 15, closing each of the three contact pairs (A–C). When the control voltage is removed from the terminals $C_1$–$C_2$, the plunger returns to the position illustrated in FIG. 3. Due to the presence of springs 17, appreciable movement of plunger 13 occurs before the contact pairs are open.

As thus far described, the contactor 11 is substantially conventional. In accordance with the invention, an arc suppression apparatus is provided for the contactor 11 which includes an arc suppression circuit 18 and a mechanical switch 19, which is described hereinafter in detail. The circuit 18 includes three triacs 21, 22 and 23

(FIG. 2) coupled across the three pairs of power contacts A, B and C, respectively. The electrical connections to the circuit 18 are shown in the circuit diagram of FIG. 2, but are omitted from FIG. 1 to avoid obscuring mechanical features of the contactor and the arc suppression apparatus.

In order to provide arc suppression at the three power contacts A, B and C, the triacs 21–23 are gated into conduction for an interval of time beginning before, and concluding after, the power contacts A, B and C are either opened or closed. To produce a gating signal for the triacs, a gating circuit is provided which is initially activated by closure of mechanical switch 19. More particularly, a dc potential is derived from one of the phases of the three phase ac source coupled to the contactor. This dc potential is developed at a contact 24 of the switch 19 from a half wave rectified dc power supply made up of a diode 26, a resistor 27, and a capacitor 28 connected in series across a phase of the ac source. The dc potential at the contact 24, which is used to effect the gating of the triacs, is the voltage developed across the capacitor 28.

The timing of the application of the dc voltage to the gating circuitry for the triacs is determined by the closure of the switch 19. As the contactor plunger 13 moves to either open or close the power contacts, the switch 19 is momentarily closed. The switch 19 then reopens before the plunger has completed its travel. The switch 19 is arranged such that it closes as the plunger 13 begins to move but before the power contacts actually are opened or closed under the influence of the plunger movement.

When the switch 19 closes, the potential on the power supply capacitor 28 is transferred through the switch to a capacitor 29 in the charging circuit. The power supply capacitor 28 is selected to be significantly larger than the capacitor 29, such as ten times its size, so that the capacitor 29 is virtually instantaneously fully charged. Also when the switch 19 closes, each of the triacs 21–23 is gated into conduction.

To gate the triacs, gating current is supplied through a series circuit from the positively charged side of the capacitor 29 (and from the capacitor 28 while the switch 19 is closed) through a current limiting resistor 31 and three opto-isolators 32, 33 and 34, each of which is coupled to one of the three triacs 21, 22 and 23, respectively. The circuit path returns to the low side of the capacitors 28 and 29.

Each of the opto-isolators conducts the dc supply current through a light-emitting diode 37, and the light-emitting diode gates on a "triac" 36 in the opto-isolator. When the "triac" 36 in the opto-isolator 32 is gated on by the conduction of current through the diode 37, the triac 21 is gated on through a gate resistor 38 which is coupled to the three-phase power source. The triac 21 then conducts current between the source and the load. In the same manner, the triacs 22 and 23 are also gated into conduction.

As shall be described below, the switch 19 closes, rendering the triacs 21–23 conductive, prior to the opening or closing of the power contacts A, B and C. In the case where the power contacts are to be closed, for example, the movement of the plunger 13 in the contactor effects the closure of the switch 19 before the power contacts close. Subsequently, the contacts A, B and C close, and the switch 19 opens as the plunger 13 completes its travel. The triacs 21–23, however, do not cease to conduct when the switch 19 opens. The triacs remain gated until the capacitor 29 in the charging circuit discharges through the above-described circuit path of the resistor 31 and the opto-isolators. Therefore, the interval of time of conduction of the triacs may be substantially determined by the selection of the value of the capacitor 29 and the resistor 31. For example, the components may be selected to obtain a total triac "on-time" of 30–40 milliseconds. This amount of time will assure that the contacts A, B and C are fully closed, after any contact "bounce" has ceased, before the triacs turn off.

The above-described sequence of operation occurs whenever the power contacts A, B and C are either opened or closed. In either case, the switch 19 is first opened, then momentarily closed, and subsequently opened again. Therefore, arcing at the power contacts A, B and C is suppressed due to the conduction of the triacs 21–23, connected in parallel with the power contacts, before, during, and after the opening or closing of the power contacts.

With reference now more particularly to FIGS. 1 and 3, the construction of contactor 11 and switch 19 shall be described in more detail. As there shown, contactor 11 includes a plunger 13 mounted for vertical movement within a contactor housing 60. Switch 19 is preferably mounted upon a side wall 61 of housing 60. FIG. 3 illustrates the contactor plunger 13 in the "contacts open" position, from which the plunger must move downwardly through a certain amount of travel to reach a "contacts closed" position, wherein the movable contacts 16 are moved downwardly into engagement with the stationary contacts 15. The switch 19 includes a movable contact 52 carried by a vertically movable wiper arm 46. A motion multiplying linkage 62 interconnects wiper arm 46 and the movable plunger 13. Wiper arm 46 is mounted for vertical movement relative to the switch housing. As shown in FIG. 1, the interior of the contactor housing is accessible through an opening 42. The motion multiplying linkage includes a lever arm 43 which is interconnected through opening 42 to an element 41 which is in turn mounted for movement with plunger 13. The element 41 may be, for example, a portion of the insulated contact mounting 14, which moves vertically with plunger 13. The element 41 is in its raised position when the power contacts are open, as illustrated in FIG. 3. The element 41 is moved downwardly to the bottom of the opening 42 when the power contacts are closed by the downward movement of the plunger 13.

Lever arm 43 is pivotally connected to member 41 through a pin 44 which extends through opening 42. The opposite end of the arm 43 is coupled to the movable wiper arm 46 of the switch 19 by means of a pin 48 connected to the wiper arm. Pin 48 slidably engages the walls of a seat 45 formed in the end of lever arm 43. Arm 43 is pivotally mounted by pin 47 to wall 61 of the contactor 11. The pin 47 is located approximately one-third of the distance from the pin 44 toward the wiper arm 46. In this way, the vertical movement of the element 41 is translated by the arm 43 into a vertical motion of approximately twice that for the wiper arm 46.

Also mounted within switch 19, and spaced apart from one another along the path of the wiper arm 46, are the fixed contact 24 and a second fixed contact 51. These fixed contacts 24, 51 are located such that the conductive portion 52 carried by the wiper arm 46 does not close the fixed contacts when the element 41 is in either its upper or lower rest positions and the power contacts A, B and C are either open or closed. The position of the conductive portion 52 when the power contacts are open is illustrated in FIG. 1 in solid lines, and the position of the conductive portion when the power contacts are closed is illustrated in phantom in FIG. 1. The fixed contacts 24 and 51 are located along the path of the wiper arm 46 so that the conductive portion 52 engages the fixed contacts, closing the switch 19, shortly after movement of the plunger 13 to either open or close the power contacts.

While the invention has been described in connection with a particular power contactor device 11, and a particular mechanical construction for the switch 19, it will be understood that it is also applicable to other contactors and other mechanical power switching devices.

In operation, assuming that the contactor contacts are open and a signal is applied to terminals C1 and C2, the plunger 13 begins to move downwardly. The downward movement of the plunger 13 is coupled to the motion multiplying linkage 62 by the pin 44, and the wiper arm 46 of the switch 19 moves upwardly at approximately twice the rate of movement of the plunger 13. Before the power contacts A–C are closed, the conductive portion 52 of the wiper arm engages the fixed switch contacts 24, 51, closing the switch 19. When the switch 19 closes, the triac charging circuit is coupled to the dc potential developed at the fixed contact 24, and the triacs are gated into conduction. Further travel of the plunger downwardly closes the power contacts A–C and also moves the conductive portion 52 of the switch 19 above, and out of contact with, the fixed switch contacts 24, 51.

The power contacts A–C now close, perhaps with a certain amount of contact bounce. The triacs continue to be conductive, despite the opening of the switch 19, due to the electrical charge stored by the capacitor 29 in the charging circuit. The capacitor 29 discharges at a rate determined by the size of the capacitor and of the resistor 31, to continue to provide a gating signal for the triacs. After a time interval, primarily determined by the values of the capacitor 29 and the resistor 31, and well after the power contacts A–C are completely closed and the plunger 13 at rest in its downward position, the capacitor 29 has become fully discharged. When the capacitor 29 is discharged, the gating signal is removed from the triacs, and the triacs turn off.

It should also be noted that while the invention has been disclosed with regard to an arc suppression arrangement utilizing triacs in parallel with power contacts to suppress arcing across the contacts, other gatable or activatable semiconductor devices or circuits could be used.

Figure 4:
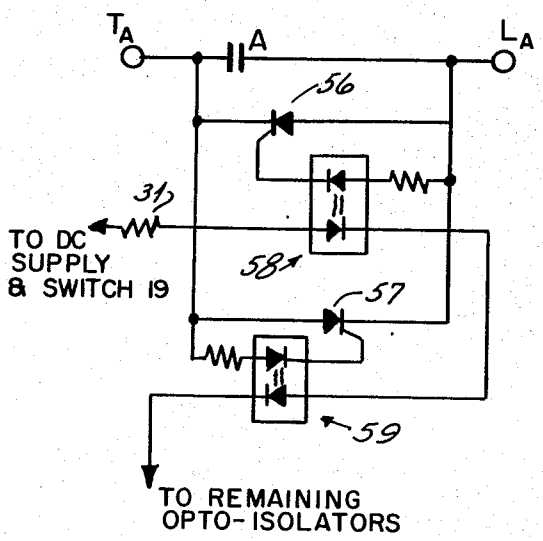
FIG. 4 is a circuit diagram of a portion of a modified form of the circuit of FIG. 2.
Figure 2:
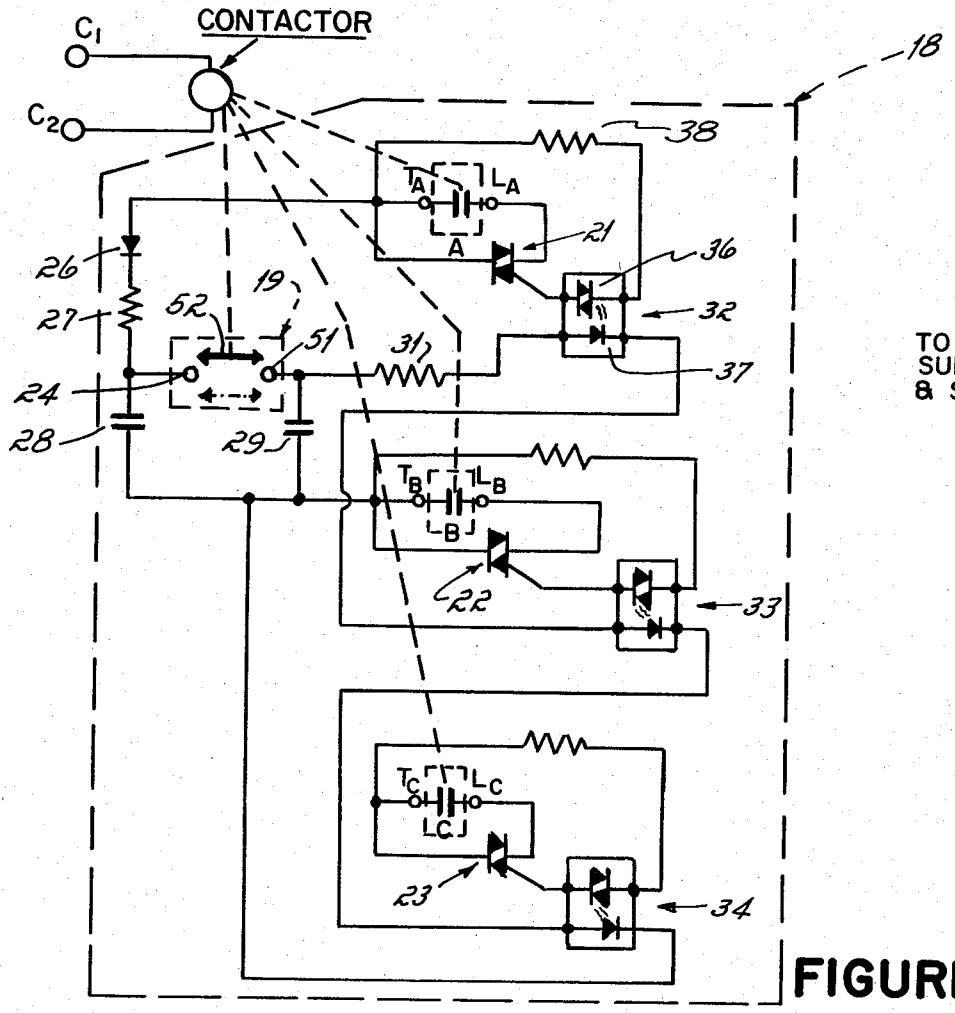
FIG. 2 is a schematic diagram of the arc suppression apparatus of FIG. 1 shown in conjunction with the contactor and its controlled contacts.

As one example, pairs of oppositely poled SCR's could be used in place of each of the triacs 21–23 shown in the circuit of FIG. 2. The circuitry for utilizing a pair of oppositely poled SCR's, for an exemplary phase of a three phase arc suppression arrangement, is illustrated in FIG. 4. As before, a number of opto-isolators have light-emitting diode portions coupled in series from the dc supply via the switch 19 and limiting resistor 31. For each phase, such as the phase A illustrated in FIG. 4, in place of a single triac 21, there are provided two oppositely poled SCR's 56 and 57 connected in parallel across the power contacts A. Each SCR 56, 57 is gated by an associated opto-isolator 58, 59 which is energized by the dc supply and the potential on the capacitor 29.

What is claimed is:

1. An arc suppression device, for an electrical power switching device having at least one pair of contacts and an element movable between a first position in which each said contact pair is open and a second position in which each said contact pair is closed, comprising:

a switch having at least two states;

switch actuation means, couplable to the movable element of the switching device, for changing the state of the switch as the movable element moves from one of its said positions to the other;

at least one gate controlled thyristor couplable across each pair of contacts of the electrical power switching device; and electronic circuit means, coupled to the switch and responsive to a change in the state of the switch, for gating on each said thyristor for an interval of time independent of a change of state of said mechanical switch.

2. The arc suppression device of claim 1 in which the electronic circuit means includes (a) means for generating a thyristor gating signal for an interval of time after being coupled to an electrical potential and (b) supply means for producing an electrical potential, which is coupled to the thyristor gating signal generating means when there is a change in the state of the switch.

3. The arc suppression device of claim 2 in which the switch has a first state when the movable element of the electrical power switching device is in either its first position or its second position and in which the switch momentarily assumes a second state as the movable element moves between said first and second positions.

4. The arc suppression device of claim 3 in which the switch is open in its first state and closed in its second state.

5. The arc suppression device of claim 4 in which the switch is interposed between the gating signal generating means and the supply means of the electronic circuit means so that an electrical potential is coupled to the gating signal generating means when the switch is momentarily in its second, closed, state.

6. An arc suppression device, for an electrical power contactor having at least one pair of contacts and an element movable between a first position in which each said contact pair is open and a second position in which each said contact pair is closed, comprising:

a mechanical switch having a movable contact;

switch actuation means, couplable to the movable element of the electrical power contactor and to the movable contact of the mechanical switch for changing the state of said switch as the movable element moves from one of its said positions to the other;

at least one gate controlled thyristor couplable across each pair of contacts of the electrical power switching device; and electronic circuit gating means, coupled to the mechanical switch and responsive to a change in the state of the switch, for gating on each said thyristor for a predetermined interval of time independent of a change of state of said mechanical switch.

7. The arc suppression device of claim 6 in which the switch actuator means increases the motion of said movable element whereby said movable contact is shifted a further distance.

8. The arc suppression device of claim 7 in which the movable contact of said mechanical switch is carried by a reciprocating wiper arm, and said switch actuating means includes a pivoted lever arm interconnected to said wiper arm and to said movable element.

9. The arc suppression device of claim 6 in which said mechanical switch and said switch actuating means are mounted upon said contactor.

10. An electrical power switching system comprising an electrical power contactor having at least one pair of contacts and an element movable between a first position in which each said contact pair is open and a second position in which each said contact pair is closed, and an arc suppression apparatus, including:

a mechanical switch having at least two states;

switch actuation means, coupled to the movable contactor element, for changing the state of the switch as the movable contactor element moves from one of its said positions to the other;

at least one gate controlled thyristor coupled across each pair of contacts of the electrical power contactor; and electronic circuit means, coupled to the switch and responsive to a change in the state of the switch, for gating on each said thyristor for a predetermined interval of time independent of a change of state of said mechanical switch.

11. The electrical power switching system of claim 10 in which the electronic circuit means includes (a) means for generating a thyristor gating signal for an interval of time after being coupled to an electrical potential and (b) supply means for producing an electrical potential, which is coupled to the gating signal generating means when there is a change in the state of the switch.

12. The electrical power switching system of claim 11 in which the electrical power contactor has three pairs of contacts, a first contact of each pair being couplable to a phase of a three phase ac power source.

13. A method for suppressing arcing at contacts of an electrical power switching device having at least one pair of contacts and an element movable between a first position in which each said contact pair is open and a second position in which each said contact pair is closed, and having at least one gate controlled thyristor coupled across each pair of contacts, comprising the steps of:

(a) actuating a mechanical switch in response to movement of the movable element to change the state of the switch as the movable element moves from one of its said positions to the other;

(b) gating on each said thyristor in response to a change in the state of the switch; and (c) electronically controlling the gating of each said thyristor to end after an electronically determined interval of time independent of the state of said mechanical switch following the change in the state of the switch.

14. The method of claim 13 in which the step (a) of actuating a switch comprises momentarily closing the switch.

15. The method of claim 14 which includes the additional step (a′), before the step (a), of coupling a source of electrical potential to the switch, and in which the step (c) comprises gating each said thyristor utilizing electrical potential which is coupled through the switch during its momentary closure, stored, and discharged to gate the thyristors during a discharge interval.

* * * * *